US007568652B2

(12) United States Patent
Cittadino et al.

(10) Patent No.: US 7,568,652 B2
(45) Date of Patent: Aug. 4, 2009

(54) EASY LOAD SHEET PRODUCT DISPENSER

(75) Inventors: Antonio M. Cittadino, Appleton, WI (US); Matthew T. Wilcox, De Pere, WI (US); Michael R. Kilgore, Little Suamico, WI (US); Karl D. Kissinger, Appleton, WI (US); Todd D. Schuelke, Fremont, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 9 days.

(21) Appl. No.: 11/866,517

(22) Filed: Oct. 3, 2007

(65) Prior Publication Data

US 2008/0087759 A1 Apr. 17, 2008

Related U.S. Application Data

(60) Provisional application No. 60/848,916, filed on Oct. 3, 2006.

(51) Int. Cl.
*B65H 16/02* (2006.01)

(52) U.S. Cl. ..... 242/594.4; 242/560.2; 242/596.8; 242/598.5

(58) Field of Classification Search ..... 242/559.2, 242/560, 560.2, 594.4, 596.8, 598.5; D6/518–523
See application file for complete search history.

(56) References Cited

U.S. PATENT DOCUMENTS

| | | | | |
|---|---|---|---|---|
| 2,121,346 | A | | 6/1938 | Harvey |
| 4,165,138 | A | | 8/1979 | Hedge et al. |
| 4,552,315 | A | | 11/1985 | Granger |
| 4,844,361 | A | | 7/1989 | Granger |
| 4,846,412 | A | | 7/1989 | Morand |
| 4,944,466 | A | | 7/1990 | Jespersen |
| D342,635 | S | * | 12/1993 | Carter et al. ..... D6/518 |
| 5,558,302 | A | | 9/1996 | Jesperson |
| 5,604,992 | A | | 2/1997 | Robinson |
| 5,628,474 | A | | 5/1997 | Krueger et al. |
| D386,025 | S | * | 11/1997 | Mervar et al. ..... D6/520 |
| 5,772,291 | A | | 6/1998 | Byrd et al. |

(Continued)

FOREIGN PATENT DOCUMENTS

| | | |
|---|---|---|
| EP | 1230886 A1 | 8/2002 |

OTHER PUBLICATIONS

International Search Report and Written Opinion of the International Searching Authority that issued Jul. 3, 2008 in connection with PCT/US2007/080322.

(Continued)

*Primary Examiner*—William A Rivera
(74) *Attorney, Agent, or Firm*—Joel Charlton

(57) ABSTRACT

A dispenser includes a cover; a housing back member; a hinge coupling the housing back member and the cover such that the cover is pivotable between an open position and a closed position, the cover and the housing back member collectively forming a housing of the dispenser; a first and second mounting bracket coupled to the housing back member; and a rotatable carousel removably mounted to the first and second mounting brackets, wherein the brackets and carousel are configured such that the carousel is movable between an inner, locked position for dispensing and an outer, rotatable position for reloading.

17 Claims, 7 Drawing Sheets

U.S. PATENT DOCUMENTS 5,979,821 A 11/1999 LaCount et al.
5,979,822 A 11/1999 Morand et al.
6,032,898 A 3/2000 LaCount et al.
6,069,354 A 5/2000 Alfano et al.
6,105,898 A 8/2000 Byrd et al.
6,138,939 A * 10/2000 Phelps et al. ..... 242/594.4
6,152,397 A 11/2000 Purcell
D441,231 S * 5/2001 Purcell et al. ..... D6/522
6,237,871 B1 5/2001 Morand et al.
6,250,530 B1 6/2001 LaCount et al.
6,293,486 B1 9/2001 Byrd et al.
6,354,533 B1 3/2002 Jespersen
6,474,591 B1 11/2002 Granger
6,592,067 B2 7/2003 Denen et al.
6,607,160 B2 8/2003 Lewis et al.
6,616,088 B2 9/2003 Lintelmann et al.
6,685,074 B2 2/2004 Gracyalny et al.
6,695,246 B1 2/2004 Elliott et al.
6,710,606 B2 3/2004 Morris
6,736,348 B1 5/2004 Formon et al.
6,742,689 B2 6/2004 Formon et al.
6,752,349 B2 6/2004 Moody et al.
6,793,170 B2 9/2004 Denen et al.
6,826,985 B2 12/2004 Broehl
6,830,210 B2 12/2004 Formon et al.
6,854,684 B2 2/2005 Byrd et al.
6,871,815 B2 3/2005 Moody et al.
6,895,848 B1 5/2005 Svennson
6,903,654 B2 6/2005 Hansen et al.
6,977,588 B2 12/2005 Schotz et al.
6,994,408 B1 2/2006 Bunnell
7,017,856 B2 3/2006 Moody et al.
D525,063 S * 7/2006 Woods et al. ..... D6/518
7,101,441 B2 9/2006 Kennard
D547,581 S * 7/2007 Cittadino et al. ..... D6/518
D551,474 S * 9/2007 Cittadino et al. ..... D6/518
D551,475 S * 9/2007 Cittadino et al. ..... D6/518
D572,058 S * 7/2008 Cittadino et al. ..... D6/518
2002/0109035 A1 8/2002 Denen et al.
2003/0167893 A1 9/2003 Morris et al.
2003/0168489 A1 9/2003 Formon et al.
2003/0168550 A1 9/2003 Formon et al.
2003/0197086 A1 10/2003 Denen et al.
2004/0035976 A1 2/2004 Byrd et al.
2004/0041057 A1 3/2004 Byrd et al.
2004/0135027 A1 7/2004 Elliott et al.
2004/0178297 A1 9/2004 Moody et al.
2005/0150992 A1 7/2005 Morris et al.
2006/0054733 A1 3/2006 Moody et al.
2007/0176041 A1 8/2007 Friesen et al.

OTHER PUBLICATIONS

Information on Product Code: 09619, Kimberly Clark Professional wbsite, http://www.kcprofessional.com/us/product-details.asp?prd_id=09619, viewed Dec. 17, 2007 (page submitted with this IDS).

* cited by examiner

EASY LOAD SHEET PRODUCT DISPENSER

CROSS-REFERENCE TO RELATED APPLICATIONS

This application claims the benefit of the filing date of U.S. Provisional Patent Application No. 60/848,916, filed Oct. 3, 2006, which is herein incorporated by reference in its entirety.

BACKGROUND

The present disclosure generally relates to sheet product dispensers, and more particularly, to sheet product dispensers for dispensing sheet product from rolls.

Dispensing of sheet products such as paper towel, tissue and the like, is common in commercial facilities such as restaurants, airports, shopping malls, service stations, and so forth. Paper products are dispensed in these facilities through the use of dispensers, oftentimes with dispensers that house multiple rolls of product. Such dispensers require re-loading on a regular basis. Thus, an important criterion for dispenser selection is the ease with which the dispenser may be re-loaded.

Accordingly, a continual need exists for sheet product dispensers that are easy to load.

BRIEF SUMMARY

Disclosed herein are sheet product dispensers.

In one embodiment, a dispenser comprises a cover; a housing back member; a hinge coupling the housing back member and the cover such that the cover is pivotable between an open position and a closed position, the cover and the housing back member collectively forming a housing of the dispenser; a first and second mounting bracket coupled to the housing back member; and a rotatable carousel removably mounted to the first and second mounting brackets, wherein the brackets and carousel are configured such that the carousel is movable between an inner, locked position for dispensing and an outer, rotatable position for reloading.

In one embodiment, a dispenser configured to dispense rolls sheet product, the dispenser including a mounting for rolls of sheet product and a housing with a back panel, top wall, a front wall and a pair of laterally opposed sidewalls and comprises a cover defining the front wall of the dispenser as well as portions of the laterally opposed sidewalls of the dispenser housing, the cover providing a pair of laterally projecting frustal sidewall domes, the frustal planes of each dome being generally parallel to the back panel, each laterally projecting frustal sidewall dome generally abutting the back panel and being frontally circumscribed by an arcuate annular margin extending outwardly therefrom and forwardly with respect to the back panel; a housing back member defining the back panel of the housing, and portions of the pair of laterally opposed sidewalls, the housing back member being configured to define a pair of laterally opposed sidewall recesses extending substantially to the back panel of the housing back member and corresponding substantially in size and shape to a rearward portion of the laterally projecting frustal sidewall domes of the cover, at least one of the housing back member and cover defining at least a portion of the top wall; and a hinge coupling the housing back member and the cover such that the cover is pivotable between an open position and a closed position, wherein the laterally projecting frustal sidewall domes of the cover are positioned, configured and dimensioned to substantially define the sidewalls of the housing in the vicinity of a roll mounting when the housing is in a closed position and to provide substantially unobstructed access to the roll mounting when the cover is in an open position.

In one embodiment, a dispenser configured to dispense rolls of sheet products, the dispenser including a mounting for rolls of sheet products and a housing with a back panel, top wall, a front wall and a pair of laterally opposed sidewalls comprises a cover defining the front wall of the dispenser as well as portions of the laterally opposed sidewalls of the dispenser housing, at least one sidewall of the cover providing a rearwardly extending projection, the rearwardly extending projection generally abutting the back panel; a housing back member defining a back of the housing, and portions of the pair of laterally opposed sidewalls, the housing back member being configured to define at least one sidewall recess extending substantially to the back of the housing back member and corresponding substantially in size and shape to a rearward portion of the rearwardly extending projection of the cover, at least one of the housing back member and cover defining at least a portion of the top wall; and a hinge coupling the housing back member and the cover such that the cover is pivotable between an open position and a closed position, wherein the rearwardly extending projection of the cover is positioned, configured and dimensioned to substantially define a portion of the sidewall of the housing in the vicinity of a roll mounted for dispensing when the housing is in a closed position and to provide substantially unobstructed access to the roll mounting when the cover is in an open position.

The above described and other features are exemplified by the following Figures and detailed description.

BRIEF DESCRIPTION OF THE DRAWINGS

Referring to the exemplary drawings wherein like elements are numbered alike in the several Figures.

DETAILED DESCRIPTION

Figure 1:
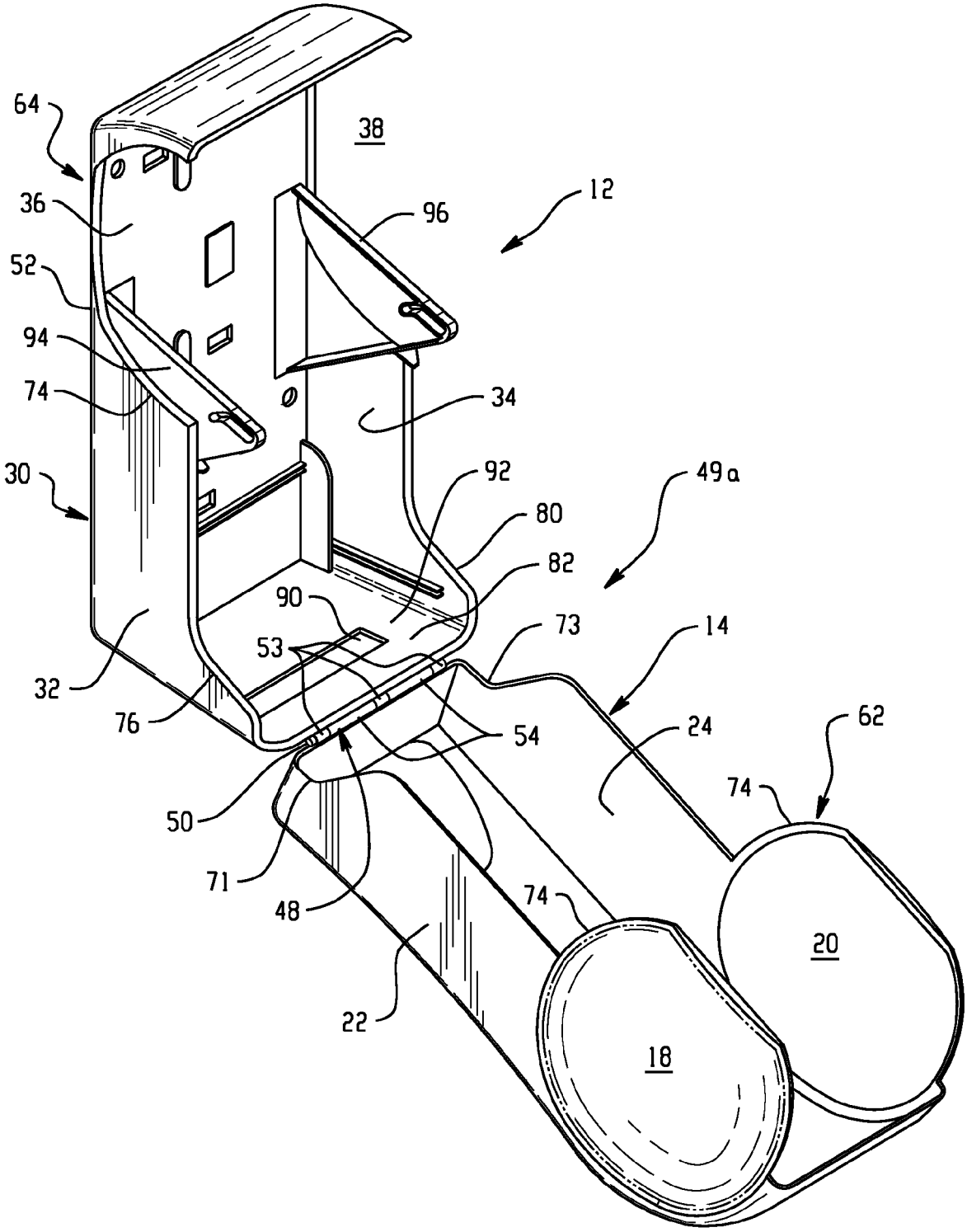
FIG. 1 is a perspective view of a housing of a dispenser in an open position.
Figure 2:
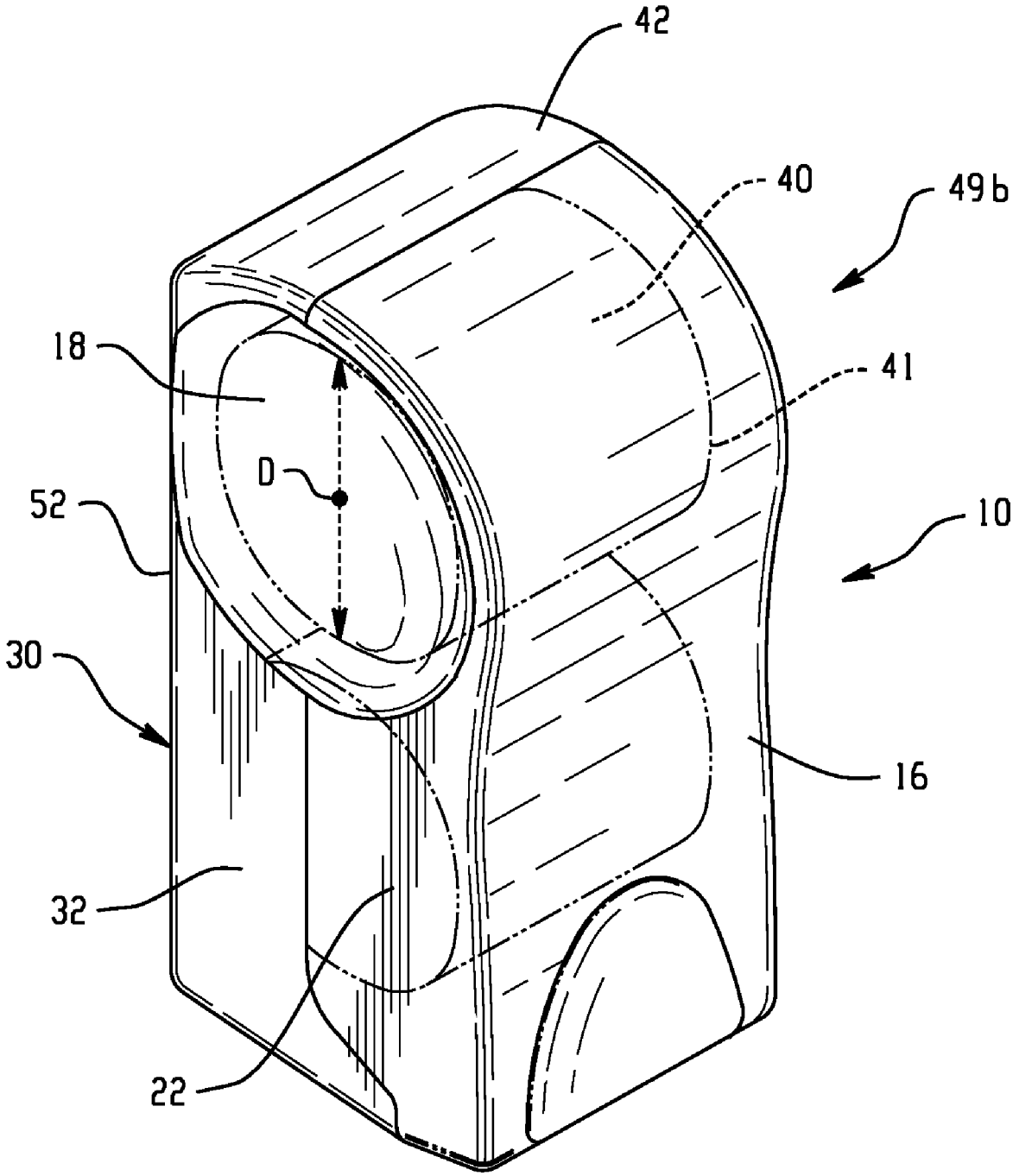
FIG. 2 is a perspective view of the housing of the dispenser in a closed position.
Figure 3:
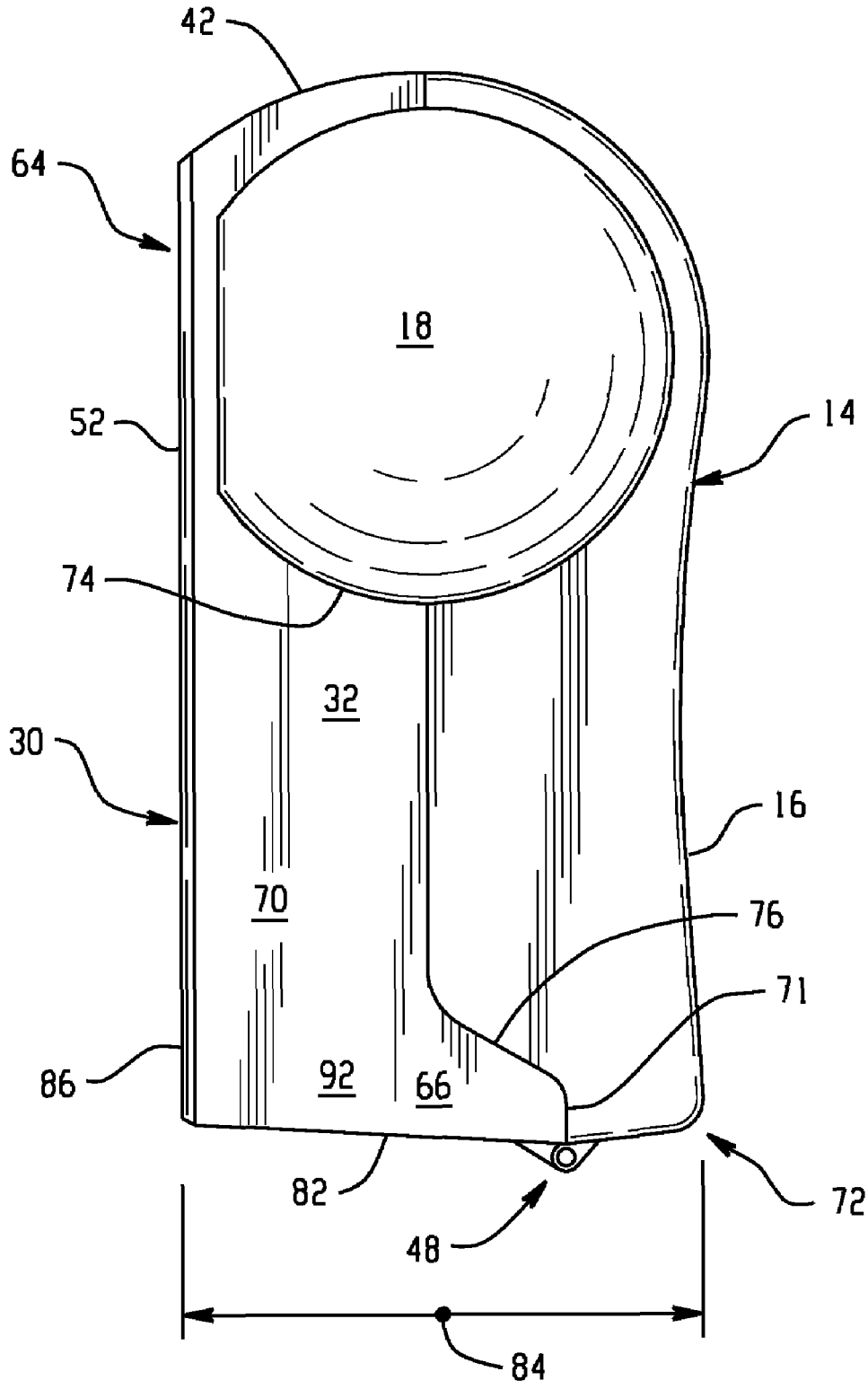
FIG. 3 is a side view of the dispenser.
Figure 4:
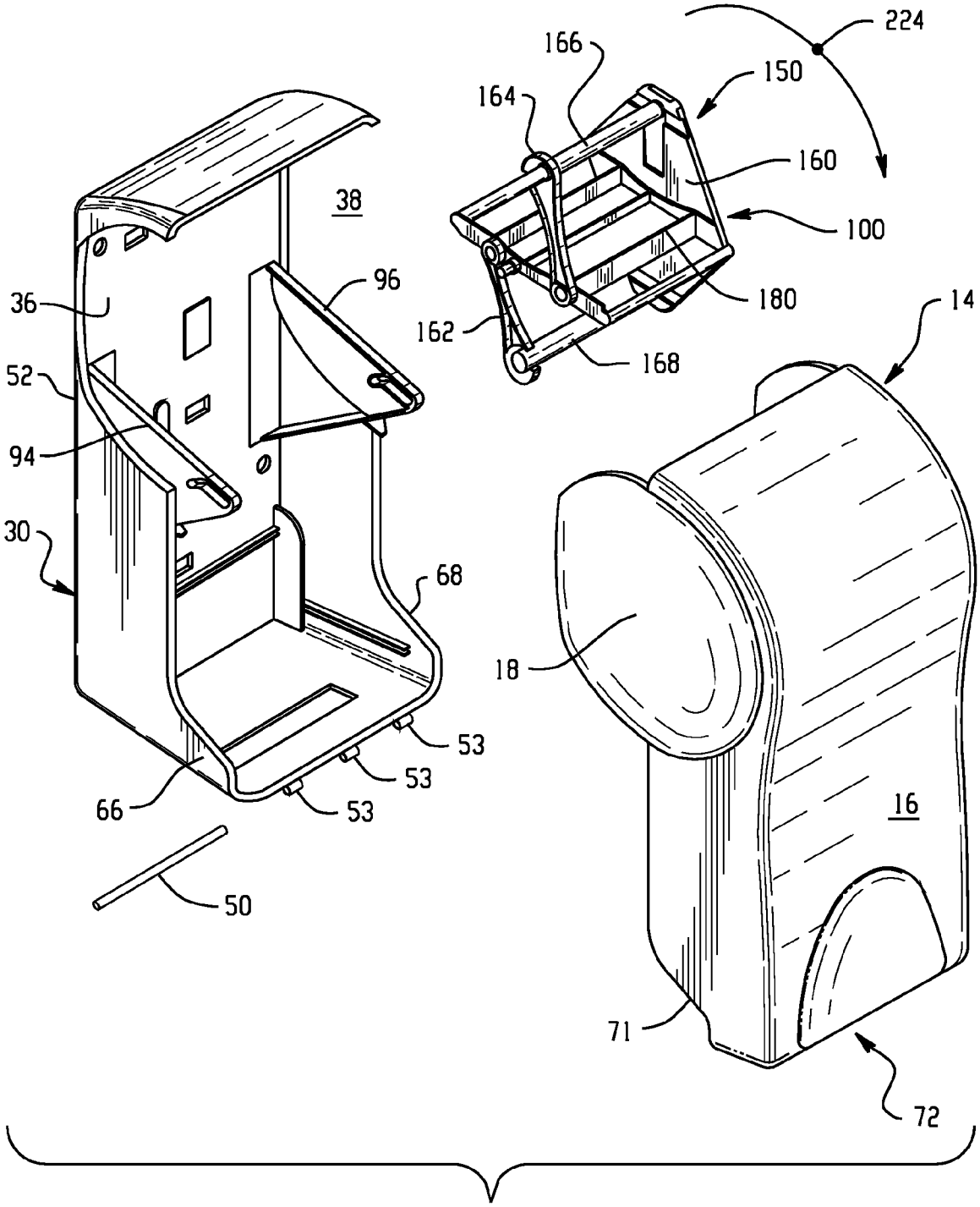
FIG. 4 is an exploded view of the dispenser illustrating the various parts.

Disclosed herein are sheet product dispensers that allow easy loading of sheet product rolls. The sheet product dispenser may be employed with one or more rolls. The term "sheet products" is inclusive of natural and/or synthetic cloth or paper sheets. Further, sheet products can include both woven and non-woven articles. Examples of sheet products include, but are not limited to, wipers, napkins, tissues, and towels.

Referring now to FIGS. 1-4, an exemplary dispenser housing, generally designated 12 is illustrated. Suitable materials for the housing 12 include, but are not limited to, metal and plastics. For ease and cost in manufacturing, in one embodiment, the components of the housing comprise an injection-molded structure made from a thermoplastic material, such as one that includes at least one of the following resins: acrylonitrile-butadiene-styrene (ABS) resins; polyacrylic resins; polycarbonate resins; polystyrene resins; and styrene-acrylic copolymer resins.

The housing 12 includes generally a cover 14 defining a front wall 16 of dispenser 10. Cover 14 includes a pair of rearwardly projecting sidewall dome lobes 18, 20. The sidewall dome lobes 18, 20 extend rearwardly to a greater extent than adjacent sidewall portions 22, 24 of the cover 14. The housing 12 also has a back housing member 30 which includes a pair of laterally spaced sidewall portions 32, 34 as well as a pair of laterally opposed sidewall recesses 36, 38 corresponding in size and location to at least about a circumference 41 of the ends of a roll 40 of sheet product, which is mounted in the dispenser 10. The size of the sidewall dome lobes 18, 20 varies depending on the intended sheet product to be employed in the dispenser 10. For example, in on embodiment, a tissue roll of diameter, D, typically of about 4 inches, may be employed.

The back housing member 30 defines a top wall 42 of dispenser 10. A hinge 48 couples the cover 14 and the back housing member 30 such that the cover 14 is pivotable between an open position 49*a* shown in FIG. 1 and a closed position 49*b* shown in FIG. 2. Hinge 48 includes a plurality of molded-in pin mounts 53 in back housing member 30 as well as a hinge pin 50 and a plurality of molded-in pin mounts 54 of cover 14.

Sidewall dome lobes 18, 20 of cover 14 and the sidewall recesses 36, 38 of back housing member 30 are positioned, configured and dimensioned such that they cooperate to define the sidewalls of the housing 12 in the vicinity of roll 40 mounted for dispensing when the housing 12 is in the closed position 49*b* and to provide substantially unobstructed access to the roll 40 when the cover 14 is in the open position 49*a*.

In one embodiment, recesses 36, 38 are generally arcuate and sidewall dome lobes 18, 20 of the cover 14 are also arcuate. For example, the sidewall dome lobes 18, 20 can be frusto-spheroidal lobes. The arcuate recesses 36, 38 of the back housing member 30 and the sidewall dome lobes 18, 20 of the cover 14 extend substantially to back panel 52 of the housing 12 which can be mounted, for example, on a universal mounting plate secured to a wall. The sidewall dome lobes 18, 20 are located at an upper portion 62 of the cover 14, while recesses 36, 38 are located at an upper portion 64 of back housing member 30. The back housing member 30 includes a pair of laterally opposed sidewall portions 66, 68 extending outwardly from a lower central portion 70 and that the cover 14 includes a pair of corresponding or congruent cover recesses 71, 73 extending toward front wall 16 at a lower portion 72 of the cover 14. The various recesses and projections cooperate in an interlocking manner as shown so that the cover 14 is securely supported by back housing member 30 over a plurality of horizontally extending segments 74, 76, 78 and 80 defined therebetween when the cover 14 is in the closed position 49*b*.

In one embodiment, back housing member 30 further defines a bottom wall 82, which extends more than 50% of horizontal span 84 between a back 86 of the dispenser 10 and front wall 16 so as to be suitable as a support platform for a drive chassis, for example, as well as defining a primary dispensing aperture 90 located at a medial portion 92 of the bottom wall 82. Back housing member 30 also includes a pair of laterally opposed mounting brackets 94, 96 for mounting a carousel assembly 100.

In one embodiment, the carousel assembly 100 is enclosed when the housing 12 is in the closed position 49*b*. An upper mounting 150 of carousel assembly 100 is substantially unobstructed when the dispenser 10 is open, for reloading, for example. Sidewall dome lobes 18, 20 are frusto-spheroidal in shape, projecting laterally from adjacent areas of the cover sidewalls and extending rearwardly generally abutting back panel 52. At the back panel 52, the sidewall dome lobes 18, 20 are truncated, such that the frustal plane of each sidewall dome lobe 18, 20 is generally parallel to back panel 52.

Referring to FIGS. 4-8, there is shown in more detail that carousel assembly 100 includes a mandrel base 160, spindle locks 162, 164 as well as mandrel support shafts (also referred to interchangeably as roll mounts) 166, 168 that may respectively include a sleeve member. A mandrel support frame 180 with axial supports 182 along a central axis of rotation 186. The supports 182 have round sections 188 as well as locking lugs 192. In order to provide for a more compact dispenser, carousel assembly 100 is movable between an inner, locked position for dispensing and an outer, rotatable position for dispensing.

Figure 5:
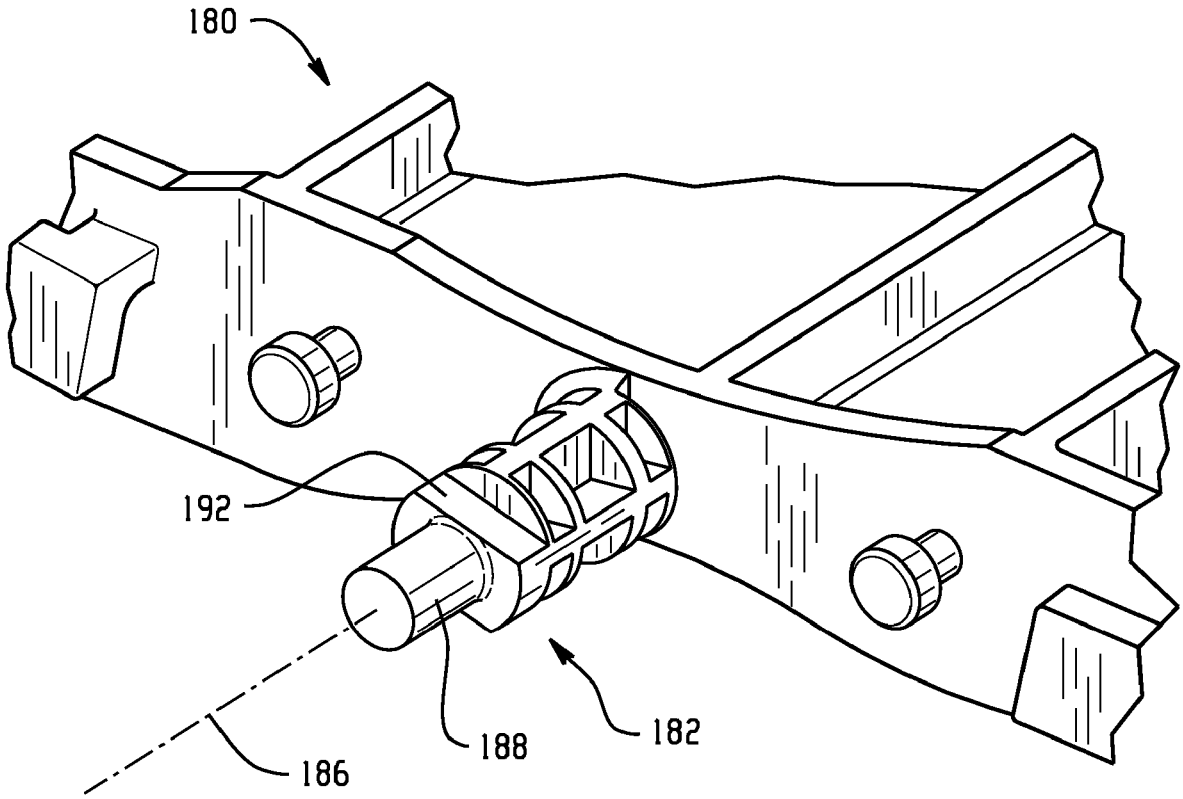
FIG. 5 is an enlarged view showing a mounting projection and locking log of a carousel frame of the dispenser.
Figure 6:
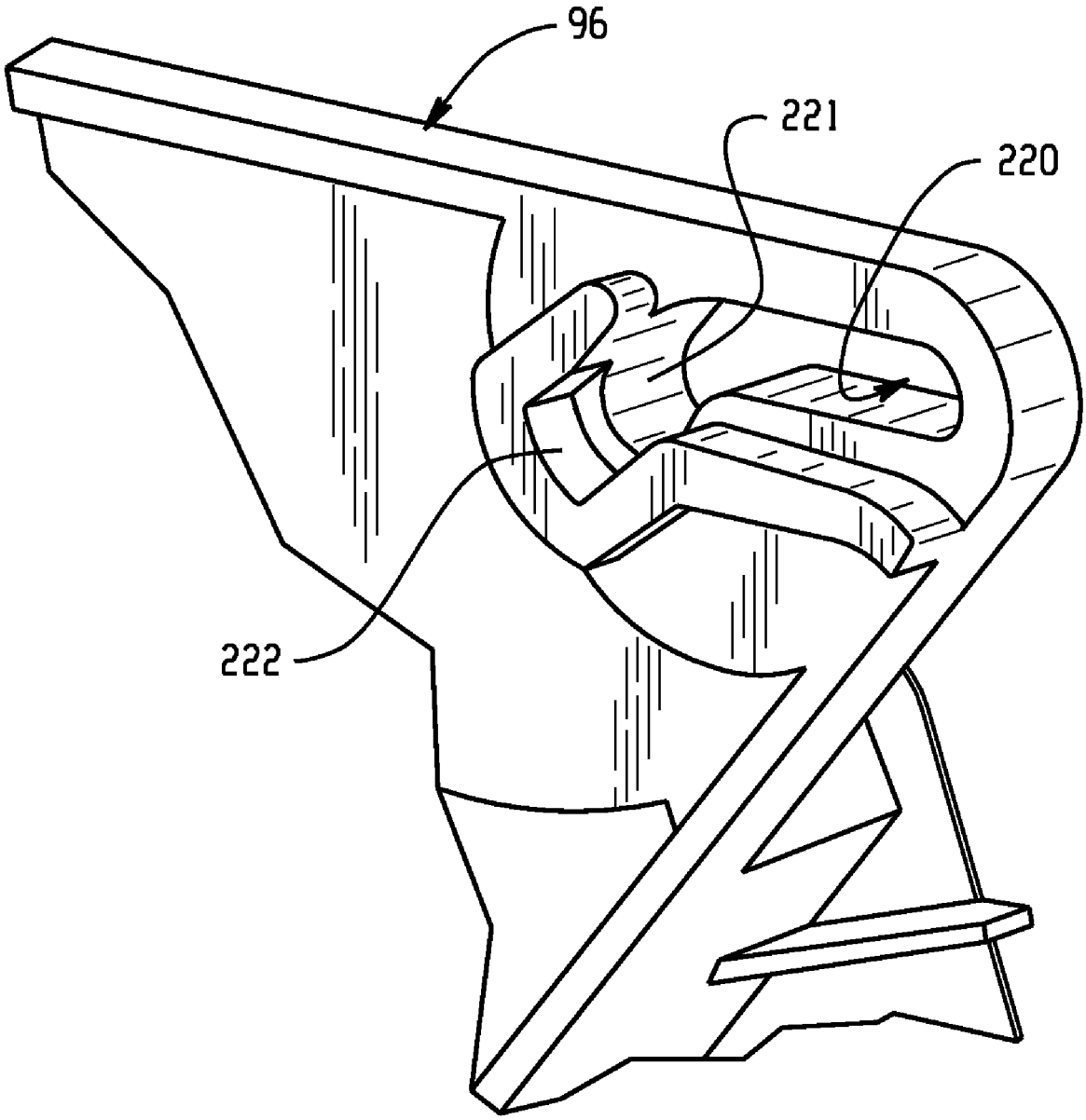
FIG. 6 is an enlarged view showing a bracket of the dispenser.

FIG. 5 is an enlarged view of support 182 (also referred to interchangeably as mounting projection 182) of frame 180 showing round section 188 as well as lug 192. Brackets 94, 96 of back housing member 30 include an angled, elongated slot 220 with a substantially horizontal portion and a downwardly extending terminus 221 adjacent a channel 222. More particularly, channel 222 is axially adjacent slot 220 along axis 186 of frame 180 when the various components are assembled as shown.

Figure 7:
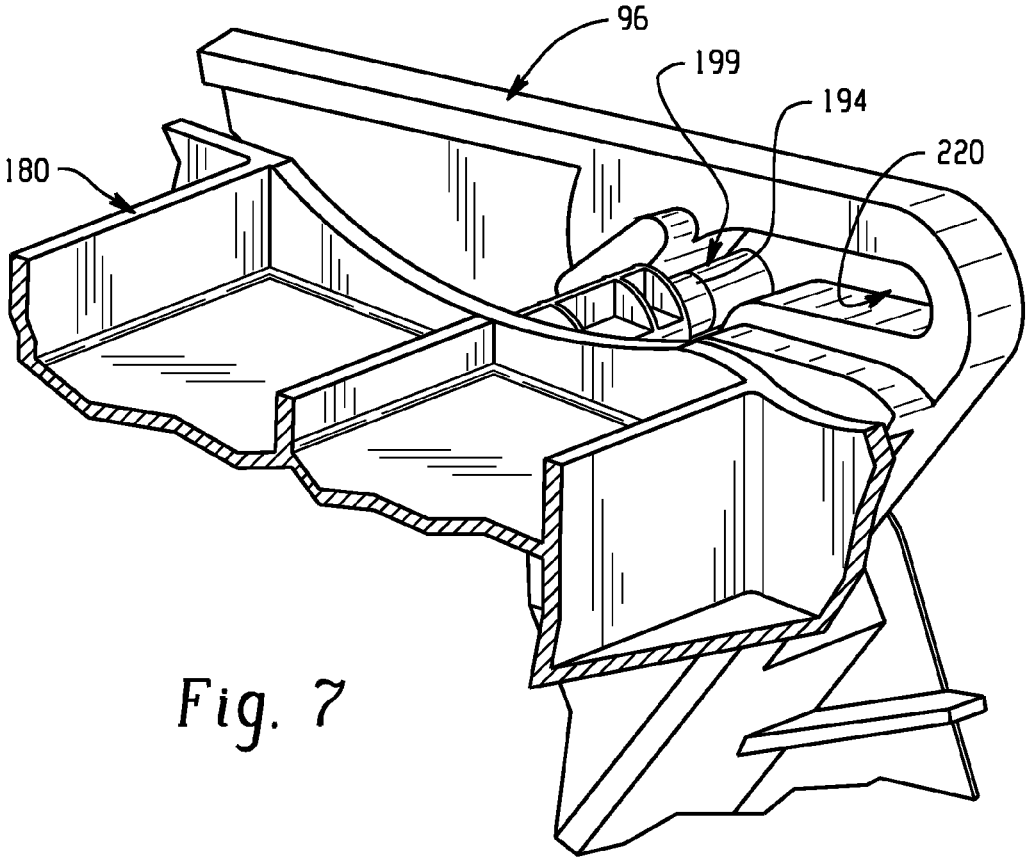
FIG. 7 is a schematic showing the carousel mounting shaft in an inner, locked position for dispensing.
Figure 8:
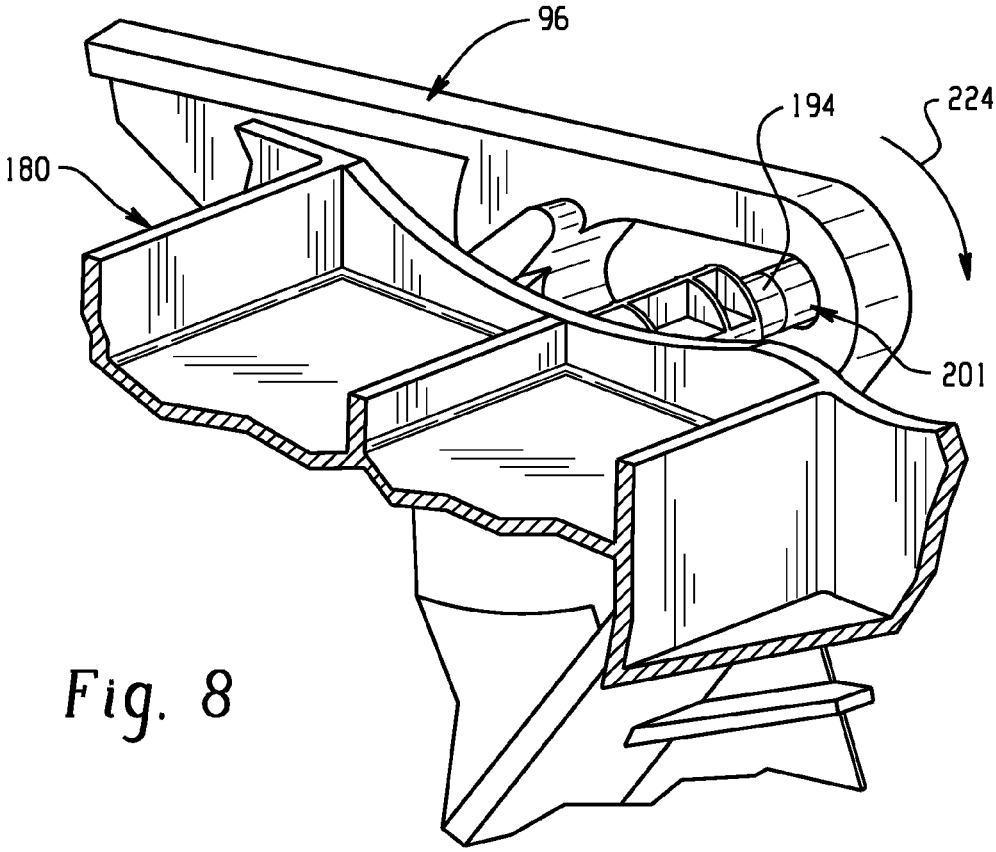
FIG. 8 is a schematic showing the carousel mounting shaft in an outer, rotatable position suitable for reloading the dispenser.

When carousel assembly 100 is mounted in brackets 94, 96 by way of frame 180, frame 180 (and thus carousel assembly 100 as well) are movable between an inner locked position 199 shown in FIG. 7 where lug 194 engages channel 222, to an outer rotatable position 201 shown in FIG. 8 where axis 186 of frame 180 has been shifted outwardly so as to provide clearance with respect to back 52 of back housing member 30 so that the carousel assembly 100 may be rotated in a direction indicated by arrow 224 for reloading.

Advantageously, the dispenser disclosed herein allows for ease in re-loading. Moreover, the use of a carousel assembly 100 allows multiple rolls of sheet product to be employed. The use of multiple rolls makes it much less likely that available sheet product will be exhausted, while the ability to move the axis of rotation 186 of the carousel assembly 100 outwardly for rotation allows for a compact dispenser profile.

While the disclosure has been described with reference to an exemplary embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. A dispenser comprising:

a cover;

a housing back member;

a hinge coupling the housing back member and the cover such that the cover is pivotable between an open position and a closed position, the cover and the housing back member collectively forming a housing of the dispenser;

a first and second mounting bracket coupled to the housing back membcr; and a rotatable carousel removably mounted to the first and second mounting brackets, wherein the brackets and carousel are configured such that the carousel is movable between an inner, locked position for dispensing and an outer, rotatable position for reloading.

2. The dispenser of claim 1, wherein the first and the second mounting bracket each include forwardly extending slots and a laterally offset locking channel at a rearward position of one of the slots and the carousel has a pair of mounting projections for mounting in the slots as well as a locking lug, wherein the locking channel and the slots of the brackets and the mounting proj&ctions of the carousel and the locking lug thereof are configured to cooperate such that the carousel is movable between the inner, locked position for dispensing and the outer, rotatable position for reloading.

3. The dispenser of claim 1, wherein the rotatable carousel includes roll mounts for at least two rolls of sheet product.

4. The dispenser of claim 1, wherein (a) the cover defines a front wall of the dispenser as well as portions of laterally opposed sidewalls of the dispenser housing, the cover providing a pair of laterally projecting fi-ustal sidewall domes, the frustal planes of each dome being generally parallel to a back panel, each laterally projecting fi-ustal sidewall dome generally abutting the back panel and being frontally circumscribed by an arcuate annular margin extending outwardly therefrom and forwardly with respect to the back panel;

the housing back member defines the back panel of the housing, and portions of the pair of laterally opposed sidewalls, the housing back member being configured to define a pair of laterally opposed sidewall recesses extending substantially to the back panel of the housing back member and corresponding substantially in size and shape to a rearward portion of the laterally projecting frustal sidewall domes of the cover;

at least one of the housing back member and cover defines at least a portion of the top wall; and the laterally projecting frustal sidewall domes of the cover are positioned, configured and dimensioned to substantially define the sidewalls of the housing in the vicinity of a mounted roll of sheet product.when the housing is in a closed position and to provide substantially unobstructed access to the roll mounting when the cover is in an open position.

5. The dispenser according to claim 4, wherein the sidewall recesses of the housing back member flare open forwardly and the laterally projecting frustal sidewall domes of the cover are generally frusto-spheroidal.

6. The dispenser according to claim 4, wherein the housing back member defines at least a portion of the top Wall of the dispenser.

7. The dispenser according to claim 4, wherein the housing back member further includes a pair of laterally opposed sidewall portions extending forwardly from a lower portion of the sidewall congruent with a pair of corresponding cover sidewall recesses at a forward lower portion of the cover.

8. The dispenser according to claim 1, wherein the cover is hinged to the housing back member at a lower extremity thereof such that the cover pivots away from a top portion of the housing.

9. The dispenser according to claim 1, wherein the housing back member defines at least a portion of the top wall of the dispenser.

10. The dispenser according to claim 1, wherein the back housing member includes a bottom wall extending more than half of the horizontal span between the back of the dispenser and the front wall thereof adapted to be a support platform for a drive chassis module.

11. A dispenser configured to dispense rolls sheet product, the dispenser including a mounting for rolls of sheet product and a housing with a back panel, top wall, a front wall and a pair of laterally opposcd sidewalls and comprising:

a cover defining the front wall of the dispenser as well as portions of the laterally opposed sidewalls of the dispenser housing, the cover providing a pair of laterally projecting frustal sidewall domes, the frustal planes of each dome being generally parallel to the back panel, each laterally projecting frustal sidewall dome generally abutting the back panel and being frontally circumscribed by an arcuate annular margin extending outwardly therefrom and forwardly with respect to the back panel;

a housing back member defining the back panel of the housing, and portions of the pair of laterally opposed sidewalls, the housing back member being configured to define a pair of laterally opposed sidewall recesses extending substantially to the back panel of the housing back member and corresponding substantially in size and shape to a rearward portion of the laterally projecting frustal sidewall domes of the cover, at least one of the housing back member and cover defining at least a portion of the top wall; and a hinge coupling the housing back member and the cover such that the cover is pivotable between an open position and a closed position, wherein the laterally projecting frustal sidewall domes of the cover are positioned, configured and dimensioned to substantially define the sidewalls of the housing in the vicinity of a roll mounting when the housing is in a closed position and to provide substantially unobstructed access to the roll mounting when the cover is in an open position.

12. The dispenser according to claim 11, wherein the sidewall recesses of the housing back member flare open forwardly and the laterally projecting frustal sidewall domes of the cover are generally frusto-spheroidal.

13. The dispenser according to claim 11, wherein the housing back member defines at least a portion of the top wall of the dispenser.

14. The dispenser according to claim 11, wherein the housing back member further includes a pair of laterally opposed sidewall portions extending forwardly from a lower portion of the sidewall congruent with a pair of corresponding cover sidewall recesses at a forward lower portion of the cover.

15. The dispenser according to claim 11, wherein the cover is hinged to the housing back member at a lower extremity thereof such that the cover pivots away from a top portion of the housing.

16. The dispenser according to claim 11, wherein the housing back member defines at least a portion of the top wall of the dispenser.

17. The dispenser according to claim 11, wherein the back housing member includes a bottom wall extending more than half of the horizontal span between the back of the dispenser and the front wall thereof adapted to be a support platform for a drive chassis module.

* * * * *